US008712305B2

(12) United States Patent
Mathea

(10) Patent No.: US 8,712,305 B2
(45) Date of Patent: Apr. 29, 2014

(54) APPARATUS FOR ELECTROGRAPHIC PRINTING OR COPYING

(75) Inventor: Hans Mathea, Eggenstein-Leopoldshafen (DE)

(73) Assignee: Markem-Imaje CSAT GmbH, Heidelberg (DE)

( * ) Notice: Subject to any disclaimer, the term of this patent is extended or adjusted under 35 U.S.C. 154(b) by 453 days.

(21) Appl. No.: 12/924,594

(22) Filed: Sep. 30, 2010

(65) Prior Publication Data

US 2011/0058868 A1 Mar. 10, 2011

Related U.S. Application Data

(63) Continuation-in-part of application No. PCT/DE2009/000379, filed on Mar. 24, 2009.

(30) Foreign Application Priority Data

Apr. 1, 2008 (DE) ..... 10 2008 016 089

(51) Int. Cl.
*G03G 15/20* (2006.01)

(52) U.S. Cl.
CPC ..... *G03G 15/20* (2013.01); *G03G 15/2003* (2013.01)
USPC ..... 399/335

(58) Field of Classification Search
CPC ..... G03G 15/2003; G03G 15/2053
USPC ..... 399/335
See application file for complete search history.

(56) References Cited

U.S. PATENT DOCUMENTS 3,561,130 A * 2/1971 Galitz ..... 34/449
4,537,492 A 8/1985 Lein

FOREIGN PATENT DOCUMENTS

DE 26 13 066 9/1977
JP 10254265 A * 9/1998 ..... G03G 15/20

OTHER PUBLICATIONS

Machine translation of JP10-254265.*

* cited by examiner

*Primary Examiner* — David Gray
*Assistant Examiner* — Andrew Do

(57) ABSTRACT

In an apparatus for the electrographic printing or copying of an object wherein a toner is applied to a medium according to the object to be printed or copied and the toner is fixed to the medium by the application of heat, a hot air blower is provided which directs hot air onto the medium and whose inlet is connected to a suction line having an intake end which is arranged remote from the hot air blower in close proximity of the medium being heated.

8 Claims, 1 Drawing Sheet

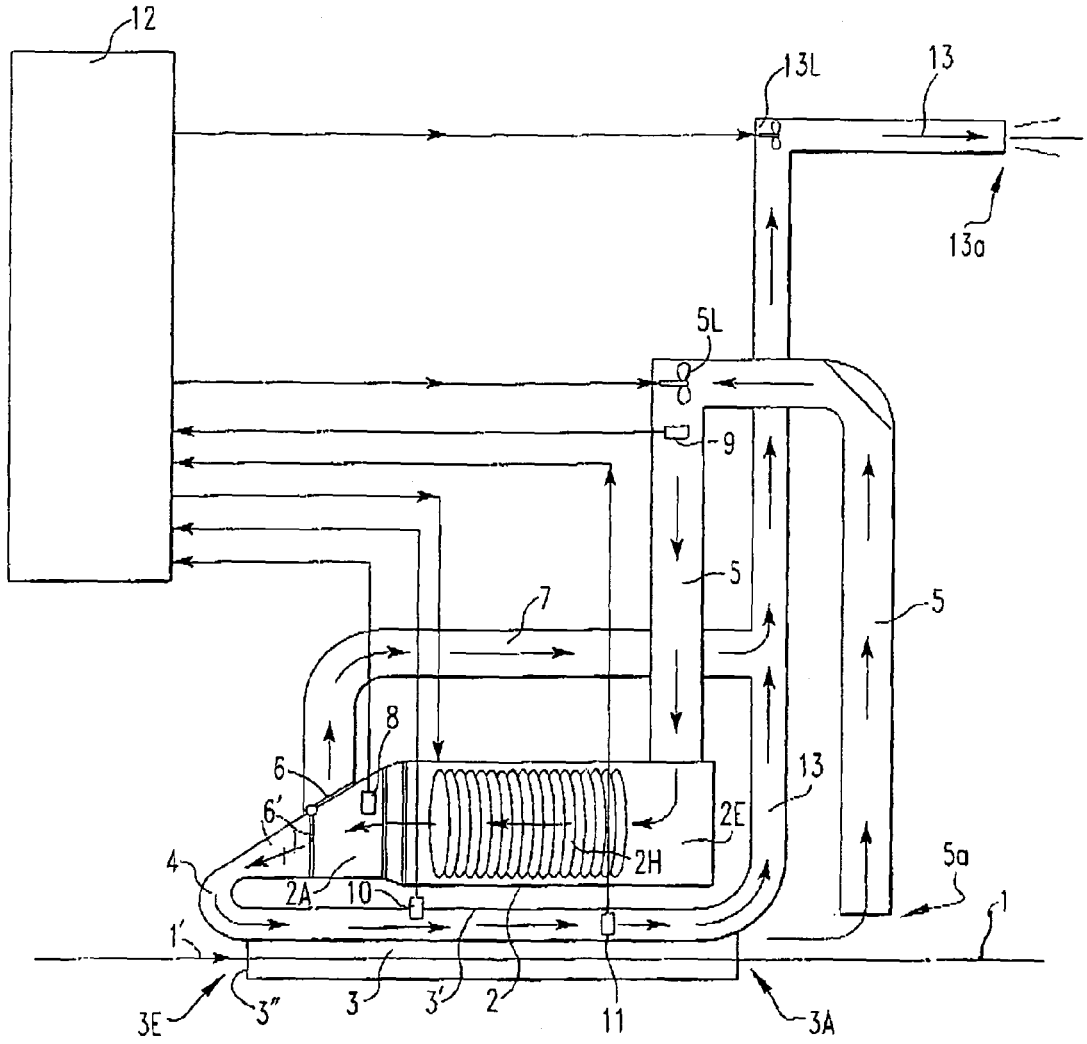
12
13L
13
13a
5L
9
5
7
5
8
6
6'
13
2E
2H
4
2A
10
5a
1
1'
3E
3"
3
3'
2
11
3A

APPARATUS FOR ELECTROGRAPHIC PRINTING OR COPYING

This is a continuation-in-part application of pending international patent application PCT/DE2009/000379 filed Mar. 3, 2009 and claiming the priority of German patent application 10 2008 016 689.8 filed Apr. 1, 2008.

BACKGROUND OF THE INVENTION

The invention resides in an apparatus for the electrographic printing or copying of images wherein a toner is applied to a medium corresponding to an object to be printed or copied and is fixed on the medium by heat supplied by a hot air blower directing the hot air onto the medium.

Such an apparatus is known for example from DE 26 13 066 A1. In the known apparatus, the air heated by a heating device of the blower is conducted along the medium provided with the toner. The heating device and the blower are arranged in a closed-circuit channel which includes a straight section through which the medium provided with the toner is moved.

Since, with the closed channel, a closed circuit is provided, the thermal losses of the known apparatus are small but the closed circuit results in a contamination of the interior of the closed channel as well as the elements disposed therein which are contaminated by toner released from the medium provided with the toner. In order to prevent the occurrence of malfunctions as a result of this contamination, the elements disposed in the channel have to be cleaned regularly. In addition the contamination of the elements disposed in the channel detrimentally affects their service life.

DE 100 43 033 A1 discloses another apparatus wherein the toner is fixed on the medium to be imprinted by a flashlight. This provides for good results but has the disadvantage that, with a color print, the heat input to the differently colored image areas is different since the heat absorption capacity of different colors, in particular light colors, of the imprinted image is differs from that of other colors, in particular dark colors.

This problem does not occur in connection with printing or copying apparatus wherein heat is applied to the medium, to be imprinted by means of heated rollers. But the use of heated roller for the fixing of the image is suitable only for paper as the medium to be imprinted. However, on metal parts for example, images cannot be fixed by heated rollers.

It is further known to fix the toner on the medium to be imprinted by infrared radiation. Fixing by infrared radiation however has the disadvantage that it is slow which is particularly problematic if the printing speed changes. Furthermore, fixing by infrared radiation is not suitable for high printing speeds.

JP 2000 267 477 A further discloses an apparatus for the electrographic printing or copying wherein toner can be applied to a medium in accordance with an object to be printed or copied and can be fixed on the medium by heat. The apparatus includes a hot air blower by which heated air is directed onto the medium to which the toner has been applied. The hot air blower takes in air from the ambient.

A similar apparatus is also known from JP 57 124 770.

Furthermore, U.S. Pat. No. 4,537,492 A discloses a heat fixing station wherein copying paper is moved over heated plates for fixing. The apparatus includes among others a blower by which the copying paper is pressed onto the heated plates.

It is the object of the present invention to provide an apparatus of the type mentioned above in such a way that a color independent fixing is achieved.

SUMMARY OF THE INVENTION

In an apparatus for the electrographic printing or copying of an object wherein a toner is applied to a medium according to the object to be printed or copied and the toner is fixed to the medium by the application of heat, a hot air blower is provided which directs hot air onto the medium and whose inlet is connected to a suction line having an intake end remote from the hot air blower arranged in close proximity of the medium being heated.

With a hot air blower by which heated air is applied to a medium provided with a toner, the medium to be imprinted can be heated effectively in a simple manner. Since the hot air heats all colors essentially at the same speed, the fixing is color-independent. By heating the medium to be imprinted by, means of hot air, a high heat input can be achieved so that the fixing according to the invention occurs at high speed and, consequently, the apparatus according to the invention is suitable for high printing speeds. Furthermore, the heat supply to the medium to be imprinted is partially taken from the heated medium which is also cooled thereby and is easily controllable or adjustable.

Advantageously, the hot air blower includes an electrically operated ducting coil whose heat output is adjustable. In this way, the temperature of the heated air supplied by the hot air blower is easily adjustable. Since the heat output of the electrically operated heating coil can almost instantly be changed, the heat supply to the medium to be imprinted can be changed very rapidly so that the heat fixing according to the invention or, respectively, the apparatus according to the invention is suitable for different speeds or, respectively, reacts rapidly to a change in speed.

Advantageously, the hot air blower or, respectively, the apparatus includes an exhaust blower whose air pumping volume is adjustable. By means of the exhaust blower the air moved by the hot air blower over the heating coil and consequently, the amount of heat supplied to the medium to be imprinted can also be controlled. By controlling the air volume and the heat output of the heating coil the heat supply can be accurately dosed whereby fixing materials, which are difficult to heat and which are sensitive, is possible In a further particular embodiment of the invention, the medium is guided by a longitudinal movement through a duct into which heated air can be conducted. By conduction of the heated air into the duct, a very good heat introduction into the imprinted medium is achieved since between the medium to be imprinted and the heated air a good contact is established. Such an arrangement is therefore particularly good for high printing speeds.

In the last-mentioned embodiment, it is very advantageous if the heated air is introduced at the entrance of the duct wherein the entrance to the duct is, in the direction of the longitudinal movement of the medium, ahead of the exit at the duct. In this way, it is achieved in an advantageous manner that the medium to be imprinted is in contact with the heated air over the full length of the duct. This results in an effective heat transfer which is very advantageous for the energy balance of the apparatus.

In the last-mentioned embodiment, it has been found to be particularly advantageous to introduce the heated air into the duct via a slot nozzle whose width corresponds to the width of the duct. In this way, a very homogenous heating of the medium to be imprinted is achieved.

The energy balance of the apparatus according to the invention can further be improved in that the inlet of the hot air blower is connected to a suction line whose end remote from the hot air blower is arranged close to the heated medium as it is provided in connection with another embodiment of the invention. In this way, already preheated air is supplied to the hot air blower. Furthermore, the suctioning of heated air from the heated medium causes that the medium is faster cooled.

In another particular embodiment of the invention, a flap is arranged at the outlet of the hot air blower by which the heated air can be conducted into a discharge duct. In this way, the heated air blower does not need to be shut off with each shut down of the apparatus. During a shut down of the apparatus, the heated air can be kept away from the medium to be imprinted without delay so that an overheating of the heated medium is avoided. It is very advantageous that, with the deflection of the heated air, the parameters of the hot air blower do not need to be changed. As a result, no re-adjustment of the parameters is required with a new startup of the apparatus.

In another special embodiment of the invention, a first sensor is provided for sensing the temperature of the air supplied by the hot air blower. In this way, the heat supplied to the imprinted medium is easily controllable.

The control of the heat supply to the imprinted medium can also be improved in that a second sensor is provided for sensing the temperature of the air supplied to the hot air blower as it is provided for in another particular embodiment of the invention.

Further features and advantages of the invention will become apparent from the following description of a particular embodiment thereof described below with reference to the accompanying drawings.

BRIEF DESCRIPTION OF THE DRAWINGS

The sole FIGURE shows schematically a particular embodiment of the present invention.

As shown in the FIGURE, above a medium in the form of a metal foil 1 on which a print consisting of a toner is disposed a metal sheet wall 3' is arranged. The wall 3' is part of a rectangular channel or duct 3 through which the metal foil is guided. The front sides of the duct 3 are closed by metal objects 3" which have slots through which the foil is moved into the duct 3 or, respectively, out of the duct 3.

At the inlet 3E of the duct 3 which, in the transport direction of the foil 1, is arranged ahead of the outlet 3A of the duct 3, furthermore, a slot nozzle 4 is disposed whose width corresponds to the width of the duct 3. The slot nozzle 4 is connected at its inlet side to the outlet 2A of a hot air blower 2. The hot air blower 2 includes an electric heating coil in the form of a heating cartridge 2H. By means of the heating cartridge 2H, air which is supplied to the hot air blower via the inlet 2E of the hot air blower, can be heated. For moving the air through the hot air blower 2, a ventilator is provided. The heat output of the heating cartridge 2H is controllable by a control unit 12.

The inlet 2E of the hot air blower 2 is connected to a suction line 5. The end 5*a* of the suction line 5 remote from the hot air blower 2 is arranged, in the direction of movement 1' of the foil 1, behind the duct 3 at a small distance above the foil 1. In this way, already preheated air is supplied to the hot air blower 2 which results in energy savings. The suction line 5 includes an intake fan 5L whose speed and consequently air transport volume can be controlled by the control unit 12.

The outlet 3A of the duct 3 is connected to a discharge line 13. The end 13*a* of the discharge line 13 remote from the duct 3 leads to the ambient. In the discharge line 13, a fan 13L is arranged whose speed and consequently air transport volume can be controlled by the control unit 12.

At the outlet 2A of the hot air blower 2 or, respectively, ahead of the inlet of the slot nozzle 4, a flap 6 is arranged by which the heated air supplied by the hot air blower 2 can be redirected into a bypass line 7. To this end, the flap is supported pivotally about an axis in order to close the inlet to the slot nozzle 4 so that the heated air is directed into the bypass line 7. On the other hand, the bypass line can be closed so that the heated air is directed to the slot nozzle 4. The pivot movement of the flap 6 is indicated by an arrow 6'. The position of the flap 6 is controlled by the control unit 12. The end of the bypass line 7 remote from the hot air blower 2 is connected to the discharge line 13.

At the outlet 2A of the hot air blower 2 a first sensor 8 is arranged for sensing the temperature of the air supplied by the hot air blower 2. In the suction line 5, a second sensor 9 is arranged for sensing the temperature of the air supplied to the hot air blower 2. In addition, a third sensor 10 is arranged at the inlet 3E of the duct 3 for sensing the temperature present in the duct 3 at the inlet SE of the duct 3. A fourth sensor 11 is arranged at the outlet 3A of the duct 3 for sensing the temperature of the air present in the duct 3 at the outlet 3A of the duct 3. The signal output of the sensors 8 to 11 are connected to the control unit 12.

The imprinted image consisting of toner disposed on the foil 1 can be fixed by means of heated air. While the metal foil 1 is advanced at low speed in the transport direction 1, current is supplied to the heating cartridge 2H by the control unit 12 at such a rate that the temperature of the air provided by the hot air blower 2 is about 180° C. The ventilator 2V or respectively the suction fan 5L rotate at a relatively low speed. When the speed of movement of the foil 1 is increased also the electric energy supplied to the heating cartridge 2H and the speed of the ventilator 2V and the suction fan 5L are increased. The electric energy supplied to the heating cartridge 2H as well as the speed of the ventilator 2V and the suction fan 5L are always adapted by the control unit 12 to the travel speed of the metal foil 1. The speed of the air moved through the heating cartridge can be controlled from zero to full speed. As a result, the heat energy supplied to the foil 1 can be controlled depending on the speed of the foil. The temperature of the heating cartridge can be adjusted to 700° C. when the air speed is low.

When the foil comes to a standstill for a short period, the control unit 12 recognizes this condition and causes the flap 6 to be pivoted in the direction as indicated by the arrow 6' so as to close the inlet of the slot nozzle 4. Then the heated air provided by the hot air blower 2 is discharged via the exhaust line 13 to the ambient. Upon restart of the foil 1, the flap 6 is pivoted back to it original position, whereby the bypass line 7 is closed and the hot air provided by the hot air blower 2 is again directed through the slot nozzle 4 into the duct 3. Since during standstill of the foil 1, only the hot air was redirected but otherwise no parameters were changed, the apparatus is instantly operative again after the flap 6 is pivoted back to its original position. No startup procedures normally necessary for the reinstatement of the operation of the apparatus are needed. In particular, the heat-up time for the heating cartridge 2H after a shut down is omitted.

What is claimed is:

1. An apparatus for the electrographic printing or copying of an object wherein a toner is applied to a foil in accordance with the object to be printed or copied onto the foil and the toner is fixed on the foil by the application of heat, said apparatus including a hot air blower and a dryer duct having an inlet and an outlet through which the foil extends and through which the foil is movable in a longitudinal direction, the hot air blower being connected to the dryer duct for conducting the hot air through the dryer duct and directing the hot air provided by the hot air blower over the foil for heating the foil and fixing the toner on the foil, said hot air blower having a fresh air inlet and a hot air outlet connected to the dryer duct for providing hot air to the dryer duct, the inlet of the hot air blower being connected to a suction line having a fresh air intake end remote from the hot air blower which fresh air intake end is arranged, in the direction of movement of the foil, after the dryer duct in spaced relationship above the foil in close proximity of the heated foil so as to generate an intake air suction flow over the foil for cooling the toner fixed onto the foil leaving the dryer duct, the dryer duct also having a hot air outlet connected to a hot air discharge line for discharging the hot air to the ambient.

2. The apparatus according to claim 1, wherein the hot air blower includes an electric heating coil whose heat output is controllable.

3. The apparatus according to claim 1, wherein the hot air blower includes a fan whose air transport volume is adjustable.

4. The apparatus according to claim 1, wherein the hot air blower is connected to the inlet of the dryer duct, the inlet of the dryer duct being disposed, in the direction of the longitudinal, movement of the medium, ahead of the outlet of the duct.

5. The apparatus according to claim 1, wherein the hot air blower includes a slot nozzle with a slot having a width corresponding to the width of the duct.

6. The apparatus according to claim 1, wherein a bypass line is provided which extends from the outlet of the hot air blower to the hot air discharge air line and a flap is arranged at the outlet of the hot air blower for redirecting the hot air into a discharge air line.

7. The apparatus according to claim 1, wherein a first sensor is provided for determining the temperature of the air provided by the hot air blower.

8. The apparatus according to claim 1, wherein a second sensor is provided for determining the temperature of the air supplied to the hot air blower.

* * * * *